United States Patent [19]

Westover et al.

[11] Patent Number: 4,673,238

[45] Date of Patent: Jun. 16, 1987

[54] ONE-PIECE WRAP-AROUND CLAMPING SHELL FOR CIGAR LIGHTER

[75] Inventors: Brooke N. Westover, Stratford; Peter J. Lupoli, Hamden; John J. Comerford, Stamford, all of Conn.

[73] Assignee: Casco Products Corporation, Bridgeport, Conn.

[21] Appl. No.: 784,602

[22] Filed: Oct. 4, 1985

[51] Int. Cl.[4] ..... H01R 13/50

[52] U.S. Cl. ..... 439/890; 439/34; 439/182; 439/665

[58] Field of Search ..... 339/136–142, 339/276 SF, 182, 10, 199; 29/511, 514, 521; 219/260–268

[56] References Cited

U.S. PATENT DOCUMENTS

| | | | |
|---|---|---|---|
| 1,663,264 | 3/1928 | Thompson | 339/199 R |
| 1,848,812 | 3/1932 | Wiley | 339/199 R |
| 3,165,371 | 1/1965 | Ruocco | 339/199 R |
| 3,915,543 | 10/1975 | Pfeifer | 339/276 SF |
| 3,955,333 | 5/1976 | Fellin | 219/267 |
| 4,544,226 | 10/1985 | Lupoli et al. | 219/267 |

*Primary Examiner*—Gil Weidenfeld
*Assistant Examiner*—David Pirlot
*Attorney, Agent, or Firm*—Mitchell D. Bittman

[57] ABSTRACT

A one-piece clamping shell for electric cigar lighters, which comprises a rolled sheet-metal body of tubular configuration, having open ends and a reverse-bend clinched seam extending longitudinally between its ends. At one of its ends the body has a radially inwardly extending flange means configured as a one-turn helical thread, said flange means having notches in it, one of which is bounded by edges that are located in planes spaced axially apart an amount essentially equal to the pitch of said thread, thereby to constitute in effect a nut adapted to be screwed onto an externally threaded shell at the rear of the cigar lighter.

3 Claims, 6 Drawing Figures

ONE-PIECE WRAP-AROUND CLAMPING SHELL FOR CIGAR LIGHTER

CROSS REFERENCES TO RELATED APPLICATIONS

Copending Application for U.S. Letters Patent in the names of Brooke N. Westover, Peter J. Lupoli and John J. Comerford, Ser. No. 487,562 filed Apr. 22, 1983, entitled COMPOSITE CLAMPING SHELL FOR ELECTRIC CIGAR LIGHTERS, now: U.S. Pat. No. 4,580,856 dated Apr. 8, 1986, and having common ownership with the present application.

BACKGROUND OF THE INVENTION

This invention relates generally to electric cigar lighters of the type employed in automobiles or other motor vehicles, and more particularly to lighters of the type incorporating a socket part that is mounted on a dashboard or other panel, and a removable plug part that carries an electric heating element.

Many different constructions involving electric cigar lighters of the above type have been developed over the years. Generally, the socket of the lighter device had an out-turned flange or bezel at its front, and was inserted through a hole in the dashboard or panel, being held captive therein by a tubular clamping shell that was screwed onto the socket from the rear, behind the dashboard. The front edge of the clamping shell engaged the rear surface of the dash, and held the socket in position. That is, the dashboard or panel was sandwiched between the out-turned flange of the socket and the front edge of the clamping shell.

Most of the older model automobiles employed metal panels, and thus one part of the cigar lighter circuit was established from the metal part of the socket to the panel and ground. With the advent of newer car models involving both cost and weight reduction, plastic panels and different types of bezels are now being employed to a far greater extent. This generally necessitates the use of an additional grounding terminal or lug of some type, in electrical contact with the metal shell or body part of the socket. Previously, the electrical connection to this part was made by means of a spade lug that was welded to the clamping shell, and that was received in a cooperable grounding terminal from the vehicle electrical system. Since the clamping shell, being constituted of metal, was in electrical contact with the socket, there existed the required continuity for the ground circuit.

The clamping shell heretofore was formed from a deep-drawn metal blank requiring a number of draw operations and trimmings, and subsequent plating and finishing operations which added to the expense. On top of this, the welding of the connector lug constituted a complication in that the necessary subsequent plating and refinishing operations were time consuming and costly. A typical construction involving a drawn clamp shell is illustrated in U.S. Pat. No. 3,955,533 dated May 11, 1976, issued to F. J. Fellin, entitled CIGAR LIGHTER CLAMP SHELL, and having common ownership with the present application.

Several additional problems have also occured, however, with regard to the welding of a lug onto the clamping shell, the most important being the lack of a reliable and economical test for the integrity of the weld, and the sometimes frequent failure of the weld during the subsequent life of the component or shell.

Generally both the socket and shell were plated in order to avoid deterioration from moisture, particularly in cases where the lighters were to be mounted in the arm rests of the doors of a vehicle. Often the lighter would become wet if a window of the vehicle was inadvertently left open during a storm, or where the vehicle was exposed to a corrosive industrial or salt atmosphere.

In the past, when it was required to fasten an electrical connector in the form of a spade lug to the clamping shell, it had been customary to plate the parts after the fastening operation, since the welding disturbed any pre-existing plating. But, under any circumstance, the welding step was time consuming, involving manual labor, and this, as well as the plating of the finished parts, represented an additional expense. With the impact of the continually rising labor costs represented by the above, the clamping shell component of a cigar lighter started to become something that was cost-prohibitive and no longer economical to produce in the environment of lighters.

SUMMARY OF THE INVENTION

The above disadvantages and drawbacks of prior clamping shells for automobile cigar lighters are obviated by the present invention, which has for one object the provision of a novel and improved clamping shell which is all in one piece, and which is especially rugged and durable in its construction while at the same time being extremely economical to manufacture and mass produce.

A related object of the invention is to provide an improved all one-piece clamping shell as above set forth, which is particularly simple and also lends itself to economical, mass-production techniques and tooling equipment, thereby to enable the overall cost of the shell to be reduced significantly.

Still another object of the invention is to provide an improved all one-piece clamping shell for a cigar lighter as above characterized, wherein an integral electrical connector is incorporated as one of the elements at the time that the shell is formed from a substantially flat piece of sheet metal stock, thereby eliminating welding or other costly attachment operations of the kind that were previously required with connectors as constituting a necessary part of the device.

Yet another object of the invention is to provide an improved all one-piece clamping shell of the kind indicated, which is highly resistant to malfunctioning, being rugged and reliable to the extent that it is strong enough to resist damage during all normal handling, installation and servicing procedures.

A still further object of the invention is to provide an improved all one-piece clamping shell as outlined above, wherein manual assembly operations during its fabrication are reduced virtually to an absolute minimum, thereby eliminating excess tooling and operator related error as well as other problems arising from poor judgement on the part of personnel.

A further object of the invention is to provide an improved all one-piece clamping shell for a cigar lighter as characterized above, which can be readily fabricated with automated machinery, and wherein all portions thereof can be formed from a single blank of flat stock which optionally can be pre-plated, thus simplifying the overall manufacturing procedure and reducing overall costs while at the same time improving quality.

Yet another object of the invention is to provide a novel method for producing an all one-piece clamping shell from substantially flat stock, which method is both straightforward and economical to carry out, and results in a product that requires no separate-component assembly steps.

A still further object of the invention is to provide a novel method as above characterized, which enables an integral grounding lug to be incorporated in the clamping shell, thereby eliminating the need for any welding operations.

The above objects are accomplished by the provision of a unique one-piece clamping shell for electric cigar lighters, which is formed essentially in its entirety from a rolled sheet-metal body of tubular configuration, having open ends and a reverse-bend clinched seam extending longitudinally between its ends. At one of its ends the body has a radially inwardly extending flange means which is configured essentially as a one-turn helical thread that is integral with the body. The flange means has a plurality of notches in it, one of which is bounded by edges that are located in planes spaced axially apart an amount equal essentially to the pitch of the thread. Optionally, adjoining the integral helical thread and at the said one notch thereof is a connector lug that is also formed as an integral part of the clamping shell. The configurations required for the thread and connector lug are formed in the blank at the time that it is cut from essentially flat, pre-plated sheet metal stock.

The objects of the invention are also accomplished by a method which includes the steps of cutting out a blank with the desired lug and flange configuration, rolling the blank and said lug and flange configuration, and thereafter seaming adjoining edges of the rolled form. After the rolling, a lay-over can be accomplished of the flanges to extend them inwardly, and then the elongate edges of the flanges can be formed so as to present a rounded finished working edge for engagement with the cooperable threaded part of the cigar lighter socket.

Other features and advantages will hereinafter appear.

In the accompanying drawings, showing one embodiment of the invention:

Figure 5:
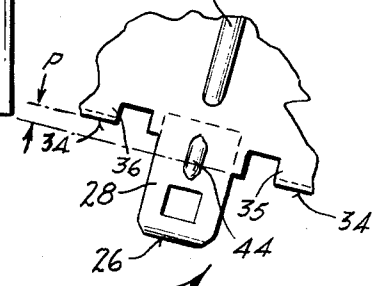
Figure 6:
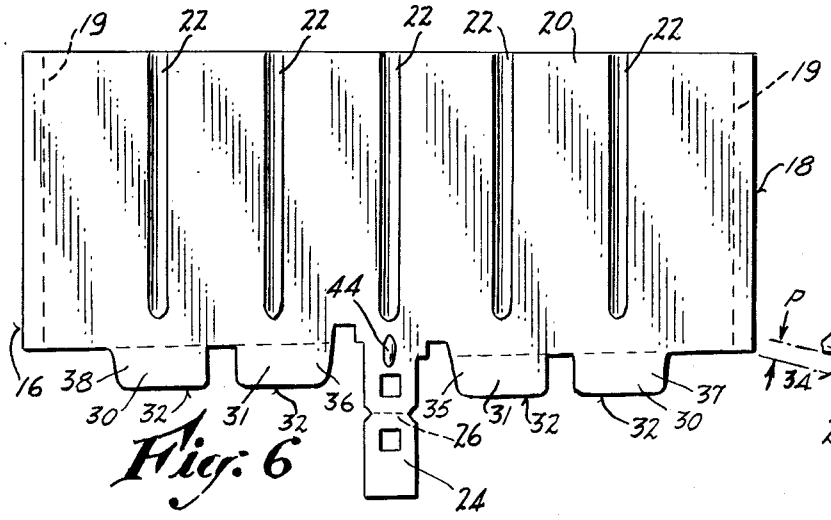

FIG. 5 is a fragmentary elevational detail showing the integral connector lug of the clamping shell and the adjoining embossed strengthening rib of the shell body, and particularly illustrating ends of the flange means on opposite sides of a notch therein, such ends being disposed essentially in planes which are spaced axially apart by an amount substantially equal to the pitch of the thread, and FIG. 6 is a plan view of the sheet metal blank after being cut out from the stock and after embossing, but prior to the rolling.

Referring to the drawings in detail, the overall or completed shell is indicated by the numeral 10 in FIGS. 1–4. As can be readily seen, it is in the form of a body 12 of tubular configuration, characterized by a crimped sheet-metal seam 14 that has joined two longitudinal edges 16 and 18 (FIG. 6) brought together by the rolling procedure. The dotted lines 19 indicate where the edges 16, 18 are involved with the crimping.

Figure 2:
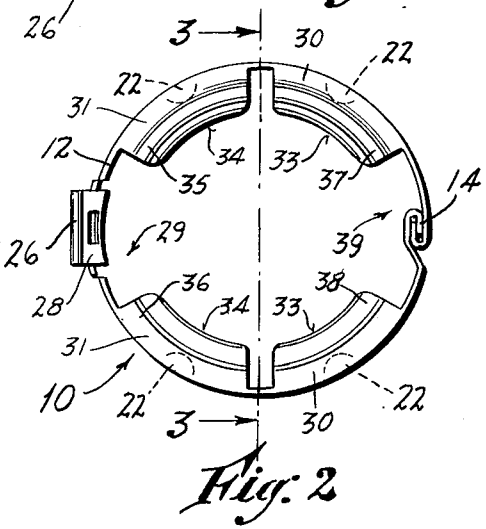
FIG. 2 is a rear end elevational view of the clamping shell.
Figure 1:
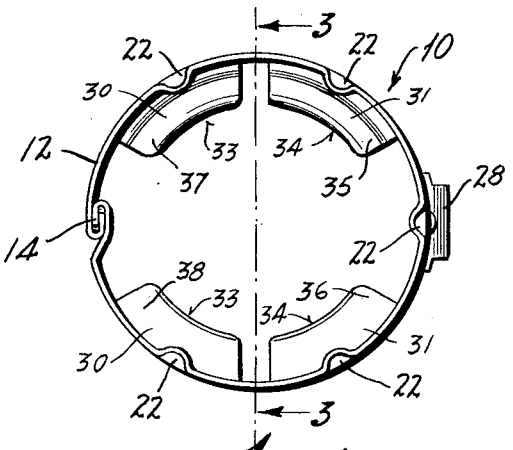
FIG. 1 is a front end elevational view of the improved clamping shell of the invention, showing at one end, arcuate radially inwardly extending flange means forming part of a convolution of a helical thread.

Prior to the rolling, the body 12 was in the form of a flat blank 20 of pre-plated sheet-metal as shown in FIG. 6. The blank 20 of FIG. 6 has a plurality of embossed ribs 22 intended to extend longitudinally in the shell after the rolling thereof, and has a protrusion 24 which is folded along the fold line 26, back on itself to form an integral connector lug 28 for the shell. The protrusion 24 is preferably aligned with one of the ribs 22, to provide added strength to the finished product. As shown in FIGS. 1 and 2, the connector lug is disposed substantially diametrically opposite to the location of the seam 14.

Figure 3:
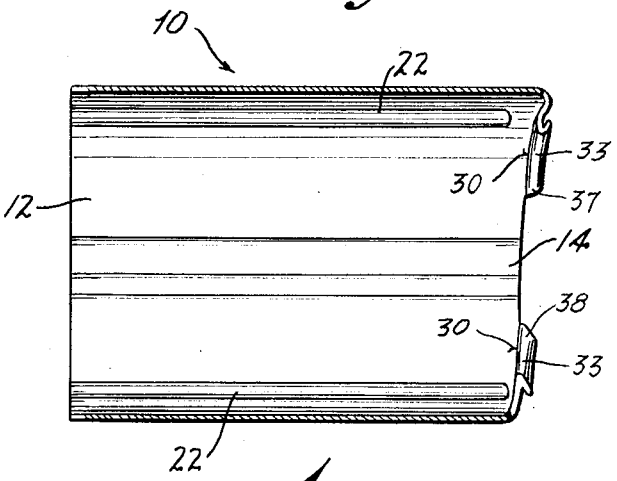
FIG. 3 is an axial sectional view taken on the line 3—3 of FIG. 1 or the line 3—3 of FIG. 2.

The blank 20 also has a plurality of extensions or flanges 30, 31 with long edges 32 that, following rolling of the blank, will be folded back to form folds 33 and 34 having a somewhat open rather than a completely flattened or tight formation as best seen in FIG. 3. The flanges 30, 31 and the respective folded edges 33, 34 thereof constitute elements of a one-turn helical screw thread designated generally by the numeral 38 in FIG. 4, and the folded back portions 33, 34 thereof constitute rounded working edges well adapted for engagement with the cooperable thread formation (not shown) of a cigar lighter socket component.

Prior to the rolling of the blank 20, the extensions or flanges 30, 31 lie flat, as in FIG. 6. During rolling, the flanges 30, 31 are rolled into arcuate shapes and by a separate later operation they are folded radially inward along a helical path, to the curved-outline flanges seen in FIGS. 1 and 2, this being possible due to the softness or ductility of the metal stock and the narrow width of the flanges. The flanges 30, 31 are given a pitch whereby in conjunction with each other they form somewhat less than a complete one turn thread. Such pitch is seen in FIGS. 3, 4 and 6 for example, and in FIG. 4, is indicated by the angle A.

Figure 4:
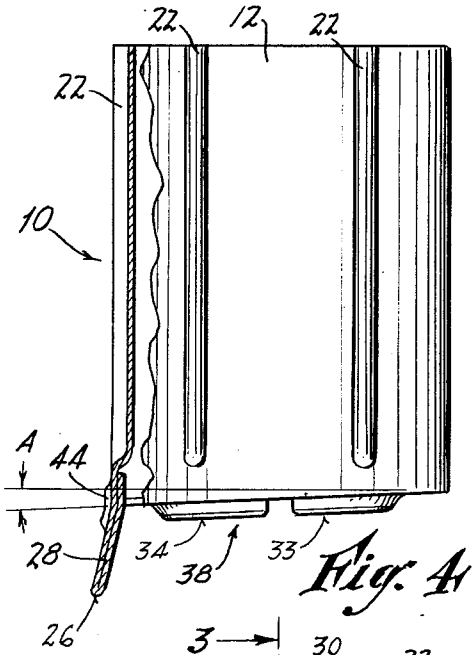
FIG. 4 is a fragmentary side elevational view of the clamping shell, projected from the top of FIG. 2.

Prior to the rolling of the body 20, the protrusion 24 is folded back on itself in the manner shown in FIGS. 4 and 5, thereby to form the double-thickness integral connector lug 28. An embossed rib 44 in the lug 28 provides additional strength, as will be understood.

The lug 28 is located in a wide notch 29 formed by the adjoining end portions 35, 36 of the flanges 31 respectively. As shown in FIG. 5, these adjoining end portions 35, 36 of the flanges 31 are disposed essentially in planes which are spaced apart by an amount substantially equal to the pitch of the thread, indicated by the letter P in the figure. As can be readily understood, the notch 29 provides a clearance space to accommodate the lug 28.

A second wide notch 39 is defined by the adjoining end portions 37, 38 of the flanges 30 respectively. The provision of this second notch eliminates potential problems which might otherwise occur as a result of interference with the seam 14. The end portions 37, 38 are in helical alignment with one another, whereby they will accommodate the corresponding thread groove of the threaded portion of the cigar lighter socket (not shown).

As shown, narrow notches are provided between the flanges 30 and 31, with the edges of the notches being in helical alignment with one another.

The thickness of the metal stock from which the clamping shell is fabricated is chosen to give the desired strength, rigidity and toughness to the end product, as will be understood. We have found that an all one-piece clamping shell as above constituted is especially economical to fabricate, that it minimizes finishing procedures, and that it is rugged and durable in service.

By virtue of the fact that there is no need to perform any welding in order to secure a lug to the clamping shell, there is eliminated an additional step in the manufacturing process. As noted above, problems with poor or inadequate welds are completely eliminated. Moreover, since no welding is involved, there is no disturbance of the pre-plated finish. All surfaces of the completed part thus retain the protection afforded by the original plating which was applied to the sheet metal stock from which the clamping shell was stamped.

Each and every one of the appended claims treats an aspect of the invention which is separate and distinct from all others, and accordingly it is intended that each claim be considered on its own merits with regard to the prior art, in any determination of novelty or validity.

Variations and modifications are possible without departing from the spirit of the claims.

What is claimed as new is:

1. An all one-piece clamping shell for electric cigar lighters, comprising in combination:

(a) a rolled sheet-metal body of tubular configuration, and constituted of sheet-metal stock, said body having open ends and a reverse-bend clinched seam extending longitudinally between its ends, (b) said body at one of its ends having a thread formation with an interruption, said thread formation being adapted for engagement with the threaded base of a cigar lighter socket, said thread formation being integral with the rolled sheet-metal body and being characterized by a diameter which is less than that of the tubular body, and (c) a spade lug integral with said body and integral with said thread formation and constituting a portion of the same sheet metal body stock, said spade lug being disposed at the interruption of said thread formation, thereby providing an especially inexpensive, one-piece clamping shell construction.

2. A clamping shell as set forth in claim 1, wherein:

(a) substantially all exposed surfaces of said body, lug, and thread formation are constituted of pre-plated sheet-metal.

3. A clamping shell as set forth in claim 1, wherein:

(a) said spade lug is constituted as a protrusion integral with said body, said protrusion being folded back upon itself to form two layers which closely overlie one another, and said lug having a thickness on the order of substantially twice the thickness of the body.

* * * * *